US005585214A

United States Patent [19]

Kashimura et al.

[11] Patent Number: 5,585,214

[45] Date of Patent: Dec. 17, 1996

[54] ELECTROPHOTOGRAPHIC PHOTOSENSITIVE MEMBER HAVING POLYCARBONATE WITH END-CURED GLYCIDYL GROUPS

[75] Inventors: Noboru Kashimura, Tokyo; Shoji Amamiya, Kawasaki; Masaaki Yamagami, Tsuruga, all of Japan

[73] Assignee: Canon Kabushiki Kaisha, Tokyo, Japan

[21] Appl. No.: 364,535

[22] Filed: Dec. 27, 1994

Related U.S. Application Data

[63] Continuation-in-part of Ser. No. 79,929, Jun. 23, 1993, abandoned.

[30] Foreign Application Priority Data

Jun. 25, 1992 [JP] Japan ..... 4-167716

[51] Int. Cl.[6] ..... G03G 5/00; G03G 15/00; G03G 15/02; G03G 15/04

[52] U.S. Cl. ..... 430/96; 430/56; 430/58; 430/66

[58] Field of Search ..... 430/56, 58, 66, 430/96; 525/461, 463

[56] References Cited

U.S. PATENT DOCUMENTS

| | | | |
|---|---|---|---|
| Re. 33,724 | 10/1991 | Takei et al. | 430/96 X |
| 5,248,578 | 9/1993 | Takaoka et al. | 430/58 |
| 5,312,708 | 5/1994 | Terrell et al. | 430/96 |

FOREIGN PATENT DOCUMENTS

| | | | |
|---|---|---|---|
| 458651 | 11/1991 | European Pat. Off. | 430/96 |

*Primary Examiner*—George F. Lesmes
*Assistant Examiner*—Bernard Codd
*Attorney, Agent, or Firm*—Fitzpatrick, Cella, Harper & Scinto

[57] ABSTRACT

An electrophotographic photosensitive member having a photosensitive layer formed on a supporting member and a protective layer formed on the photosensitive layer if necessary. At least one of the photosensitive layer and the protective layer is formed of a material containing a cured resin obtained by end-reactive curing of a polycarbonate having glycidyl end groups.

16 Claims, 2 Drawing Sheets

ELECTROPHOTOGRAPHIC PHOTOSENSITIVE MEMBER HAVING POLYCARBONATE WITH END-CURED GLYCIDYL GROUPS

CROSS-REFERENCE TO RELATED APPLICATION

This application is a continuation-in-part of application Ser. No. 08/079,929 filed Jun. 23, 1993 abandoned.

BACKGROUND OF THE INVENTION

1. Field of the Invention

This invention relates to an electrophotographic photosensitive member and an electrophotographic apparatus using the electrophotographic photosensitive member.

2. Description of the Prior Art

Conventionally, inorganic photoconductive materials, such as zinc oxide, selenium and cadmium sulfide, are known as photoconductive materials for use in electrophotographic photosensitive members. On the other hand, organic photoconductive materials, such as polyvinylcarbazole, phthalocyanine, and azo pigments, have attracted attention and found wide use because of their advantages in terms of high productivity and pollution-free properties, although they were previously unsatisfactory in terms of photoconductive characteristics and durability. Recently, organic photoconductive materials having improved photoconductive characteristics and durability have been proposed and the photoconductive characteristics of some of organic photoconductive materials presently developed are superior than those of inorganic photoconductive materials.

An electrophotographic photoconductive member must have durabilities with respect to various factors, because it repeatedly undergoes charging, exposure, development, transfer, cleaning and discharging in an electrophotography process in a laser beam printer or the like. In particular, resistance to mechanical action, such as wear resistance and scratch resistance, are the most determinative factors for extending the life of an electrophotographic photosensitive member.

Ordinarily, organic photoconductive materials such as those mentioned above are formed as a film by using a binder resin. Therefore, the wear resistance and scratch resistance of an electrophotographic photosensitive member using an organic photoconductive material are almost entirely determined by the selection of the binder resin. However, it is difficult to select a binder resin having substantially no influence upon the photoconductive characteristics of an organic photoconductive material. Therefore, the wear resistance of electrophotographic photosensitive members using organic photoconductive materials is far smaller than that of electrophotographic photosensitive members using inorganic photoconductive materials.

In an electrophotography process, a cleaning step is most influential in determining the wear resistance. With the recent changes in cleaning conditions, e.g., the reduction in developer particle size, there has arisen a need for an increase in the accuracy of cleaning operations. Also, with the progress of space saving designs, there has been a need for a simpler processing apparatus arrangement.

A cleaning method most suitably used to satisfy these needs is a blade cleaning method. Blade cleaning is performed by bringing a resilient member such as a plate-like polyurethane member against a surface of a photosensitive member. A large frictional force is thereby caused between the photoconductive member and the blade to wear down the surface of the photosensitive member. The life of the photosensitive member is thereby reduced. To cope with this problem, it is necessary to strengthen the photosensitive member.

The photosensitive member may be strengthened by using a high molecular weight binder resin or a curable binder resin. However, a high molecular weight binder resin acts to increase the viscosity of a coating material in a coating process, which is ordinarily used to manufacture organic photosensitive members. There is therefore a limitation upon increasing the molecular weight of the binder resin. A curable binder resin acts to reduce the reactivity of an organic photoconductive material at the time of curing, because impurities are formed by (1) unreacted functional groups, (2) a reaction product of a polymerization initiator or the like. Such impurities result in failure to obtain suitable photoconductive characteristics.

SUMMARY OF THE INVENTION

An object of the present invention is to provide an electrophotographic photosensitive member having improved durability resulting from improvements in resistance to mechanical action, such as wearing and scratching, without reducing or compromising electrophotographic characteristics, and an electrophotographic apparatus using such an electrophotographic photosensitive member.

To achieve this object, according to one aspect of the present invention, there is provided an electrophotographic photosensitive member wherein the material of a photosensitive layer and/or the material of a protective layer which is formed on the photosensitive layer, optionally, contains a cured resin obtained by end-reactive curing of a polycarbonate having glycidyl end groups.

According to another aspect of the invention, there is provided an electrophotographic apparatus comprising the above-described electrophotographic photosensitive member, charging means for charging the electrophotographic sensitive member, image exposure means for exposing the charged electrophotographic photosensitive member to image light to form an electrostatic latent image, and development means for developing the electrostatic latent image formed on the electrophotographic photosensitive member with a toner.

DESCRIPTION OF THE PREFERRED EMBODIMENTS

Figure 1:
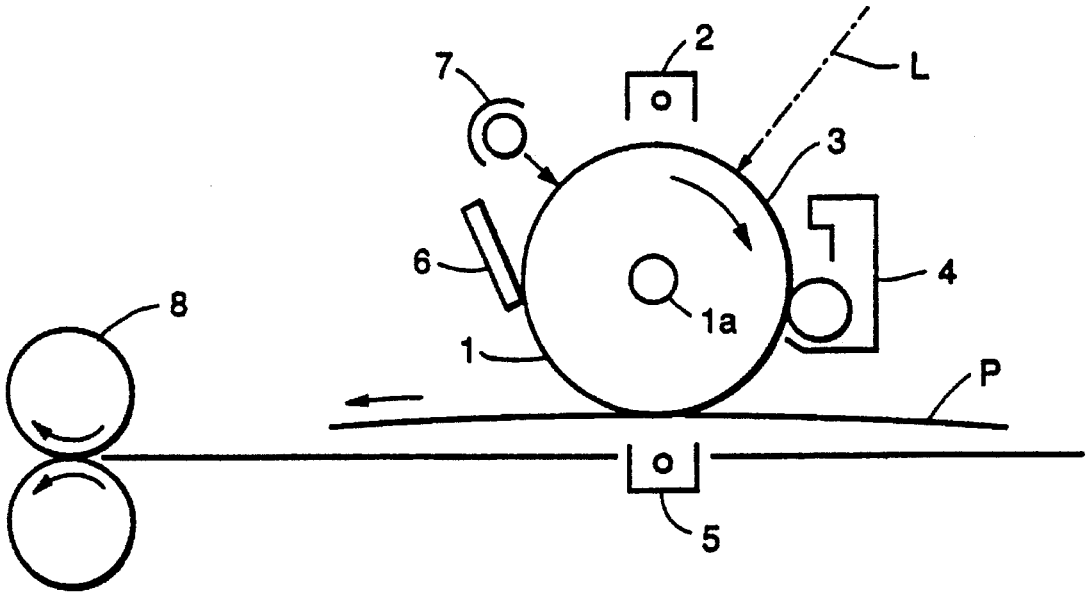
FIG. 1 is a side view of an example of an electrophotographic apparatus using an electrophotographic photosensitive member in accordance with the present invention.

An electrophotographic photosensitive member is formed having a cured resin obtained by end-reactive curing of a polycarbonate having glycidyl end groups (hereinafter referred to as polycarbonate resin "Q"). This resin is contained in the material of a photosensitive layer, the material of a protective layer, or both. Accordingly, the resin is contained in the material of a photosensitive layer, if that layer is used without a protective layer. If a protective layer is also employed, the resin is contained in either the photosensitive layer, the protective layer or in both the photosensitive and the protective layers. The protective layer is optional and is formed on the photosensitive layer if necessary.

As a polycarbonate having glycidyl end groups used in the present invention, an end-reactive polycarbonate represented by General Formula (1) is preferred.

General Formula (1):

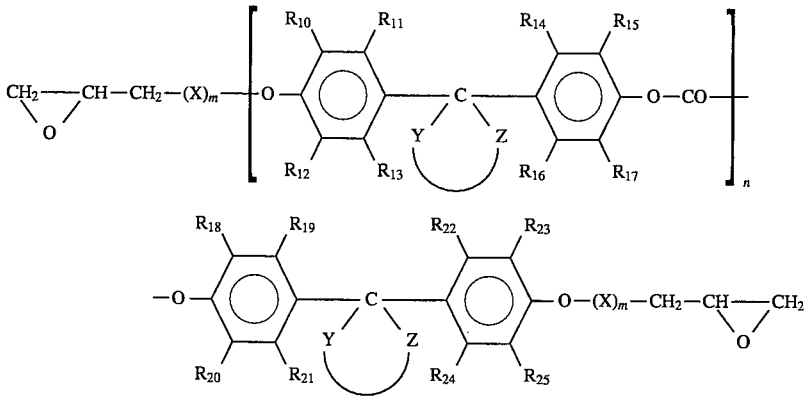

where $R_{10}$–$R_{25}$ are each a hydrogen atom, an alkyl group, an aryl group, a halogen atom or a halogenated alkyl group; X is an aryl group, an alkyl group or an aralkyl group; m is 0 or 1; Y and Z are each a hydrogen atom, an alkyl group, an aryl group, an aralkyl group, a halogen atom, a halogenated alkyl group; or together constitute a cyclic alkyl group; n is an integer; and each of X, Y, and Z is substituted or unsubstituted.

In the alkyl groups and halogenated alkyl groups represented by $R_{10}$–$R_{25}$, the number of carbon atoms is preferably 1–6.

Formula (1) polycarbonate has glycidyl groups forming its ends. Employing the reactive glycidyl groups, chains of formula (1) polycarbonate react with each other so that the resin is cured. The molecular weight (number-average molecular weight, also shortened in the following) of a polycarbonate chain:

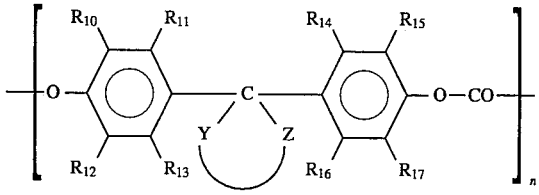

forming a main chain in the general formula (1) is, preferably, in the range of 1,000 to 100,000. For this and other purposes it is preferred that n is an integer from 3 to 340.

The number of reactive groups in any one molecule of the formula (1) polycarbonate is small and, therefore, the probability of a curing reaction of formula (1) polycarbonate is negligible. However, since the polycarbonate chain has a certain large molecular weight, the molecular weight of a formed resin chain is several times greater than that of the original polycarbonate chain, so that the resin has a sufficiently large strength. Also, since the density of reactive groups in the formula (1) polycarbonate is small, the influence of either such reactive groups which remain unreacted or their reaction products, upon the electrophotographic characteristics of the electrophotographic photosensitive member is negligible.

Preferable examples of X in the general formula (1) are shown below.

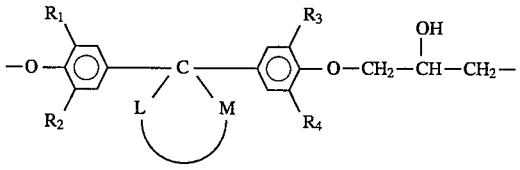

In the alkyl groups and halogenated alkyl groups represented by $R_{10}$–$R_{25}$, the number of carbon atoms is preferably 1–6.

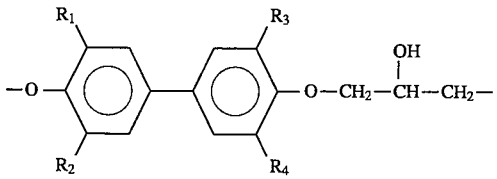

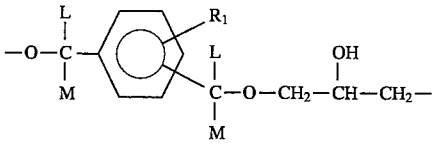

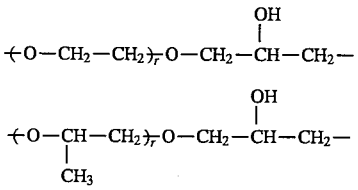

In these formulae, $R_1$, $R_2$, $R_3$ and $R_4$ are each a hydrogen atom, alkyl, halogenated alkyl, aryl, or halogen; r is an integer; and L and M are each hydrogen atom, an alkyl group, a halogenated alkyl group, an aryl group, an aralkyl group, or together form a cyclic alkyl group. $R_1$, $R_2$, $R_3$, $R_4$, L and M may have substitutional groups, and r is preferably 1 to 7 and, more preferably, 1 to 5.

Further preferable examples of X are shown below.

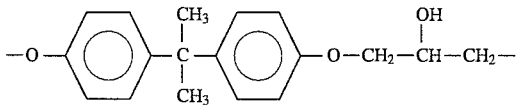

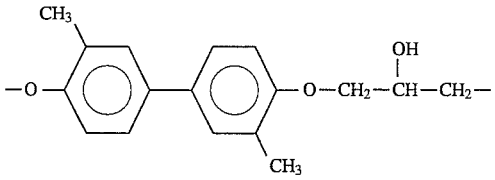

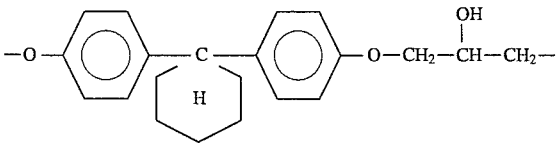

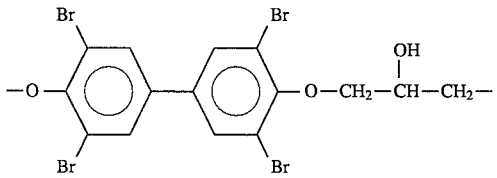

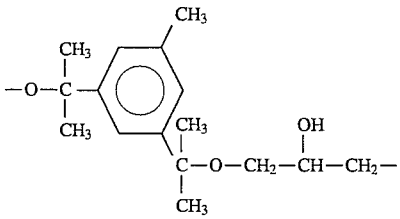

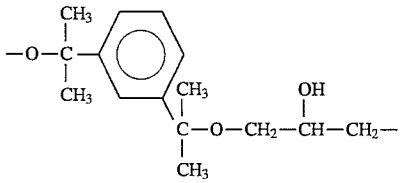

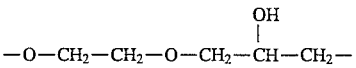

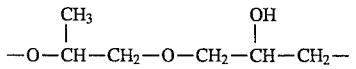

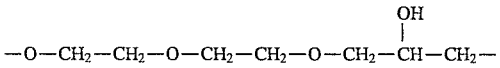

Preferable examples of a structure (2) in the general formula (1) are shown below.

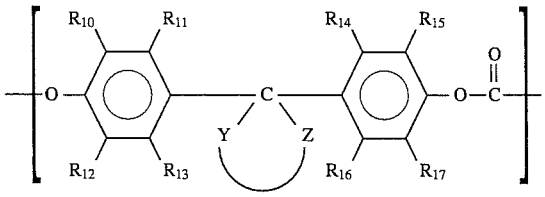

(2)

-continued

[Preferable Examples of Structure (2)]

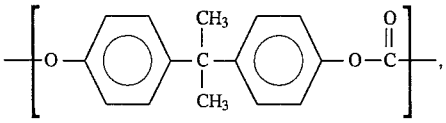

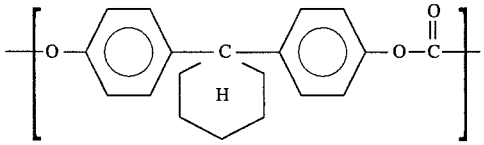

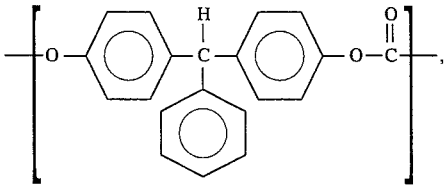

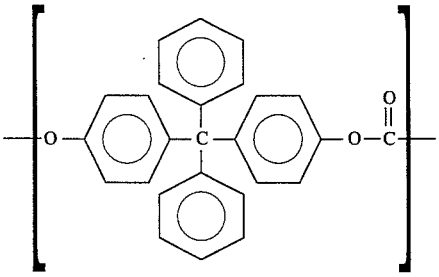

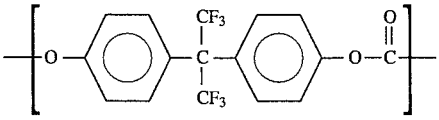

Substituents of X, Y, $R_1$, $R_2$, $R_3$, $R_4$, L and M are, for example, alkyl groups having 1 to 6 carbon atoms; aralkyl groups, such as benzyl, phenethyl and naphthylmethyl; aromatic cyclic groups, such as phenyl, naphthyl, anthryl and pyrenyl; heterocyclic groups, such as pyridyl, thienyl, furyl, and quinolyl; alkoxy groups, such as methoxy, ethoxy and propoxy; halogen atoms, such as fluorine, chlorine and bromine; nitro groups; cyano groups; haloalkyl groups or amino groups.

For example, the formula (1) polycarbonate may be synthesized as described below.

Synthesis Example

Compound A shown below is obtained by mixing a dichloromethane solution of bisphenol Z with an aqueous sodium hydroxide solution, agitating the mixed solution and introducing phosgene.

Compound A:

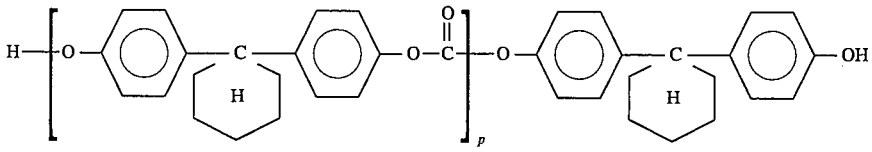

where p represents an integer, preferably from 3 to 340 and, more preferably, from 30 to 300.

Compound A and epichlorohydrin are dissolved in dichloromethane, an aqueous sodium hydroxide solution is added and the mixed solution is heated at 50° C. while being strongly agitated to obtain Compound B, an end-reactive polycarbonate, shown below.

Compound B:

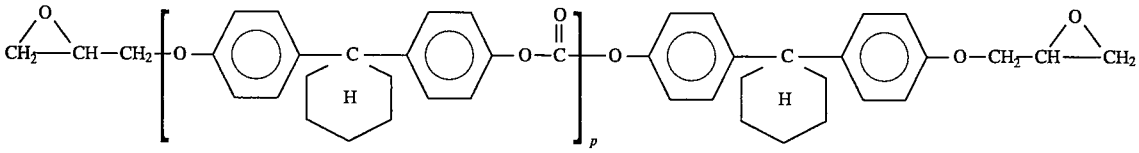

where p represents an integer, preferably from 3 to 340 and, more preferably, from 30 to 300.

In the electrophotographic photosensitive member in accordance with the present invention, a photosensitive layer may be provided as a single layer or as a laminate of a charge generation layer and a charge transport layer.

In the case of a single photosensitive layer, a charge generating material, a charge transporting material and the polycarbonate resin are included in one layer to generate and move photo-carriers in the same layer.

In the case of a photosensitive layer formed of two layers laminated together the charge generation layer containing a charge generating material and the charge transport layer containing a charge transporting material may be laminated on a supporting layer in this order or may be laminated in the reverse order. However, polycarbonate resin "(Q)" is included at least in the outer layer (remote from the supporting member). If desired, polycarbonate resin (Q) may be contained in both the charge generation layer and the charge transport layer.

Examples of the charge generating material are phthalocyanine pigments, polycyclic quinone pigments, azo pigments, perylene pigments, indigo pigments, quinacridone pigments, azulenium salt pigments, squarium dyes, cyanine dyes, pyrylium dyes, thiopyrylium dyes, xanthene dyes, quinone imine dyestuffs, triphenylmethane dyestuffs, styryl dyestuffs, selenium, tellurium, amorphous silicon, and cadmium sulfide.

Examples of charge transporting material are pyrene compounds, carbazole compounds, hydrazone compounds, N,N-dialkylaniline compounds, diphenylamine compounds, triphenylamine compounds, triphenylmethane compounds, pyrazoline compounds, styryl compounds, and stilbene compounds.

In the case of a single photosensitive layer, the thickness of the photosensitive layer is, preferably, 5 to 10 μm and, more preferably, 10 to 60 μm. In the single photosensitive layer, the content of polycarbonate resin (Q) is, preferably, 10 to 70 wt % and, more preferably, 15 to 60 wt %, and the content of each of the charge generating material and the charge transporting material is, preferably, 10 to 70 wt % and, more preferably, 20 to 70 wt %.

In the case of a photosensitive layer formed of two laminated layers, the thickness of the charge generation layer is, preferably, 0.001 to 6 μm and, more preferably, 0.01 to 2 μm, and the thickness of the charge transport layer is, preferably, 5 to 100 μm and, more preferably, 10 to 60 μm. The content of polycarbonate resin (Q) in the charge generation layer or the charge transport layer is, preferably, 10 to 100 wt %. The content of a charge generating material in the charge generation layer is, preferably, 10 to 100 wt % and, more preferably, 40 to 100 wt %. The content of a charge transporting material in the charge transport layer is, preferably, 20 to 80 wt % and, more preferably, 30 to 70 wt %.

To form the electrophotographic photosensitive member of the present invention, materials for use in the photosensitive layer are combined into a film on a supporting member by vacuum deposition or a with a suitable binder and the polycarbonate having glycidyl end groups is cured.

Examples of the binder are polyester, polyurethane, polyarylate, polyethylene, polystyrene, polybutadiene, polycarbonate, polyamide, polypropylene, polyimide, polyamide-imide, polysulfone, polyaryl ether, polyacetal, nylon, phenolic resins, acrylic resins, silicone resins, epoxy resins, aryl resins, alkyd resins, butyral resins, reactive epoxy monomers, reactive epoxy oligomers, reactive (metha)acryl monomers, and reactive (metha)acryl oligomers. One of these binder materials may be used alone or two or more of them may be used by being mixed.

Preferable examples of the reactive epoxy monomers of the reactive epoxy oligomers are shown below.

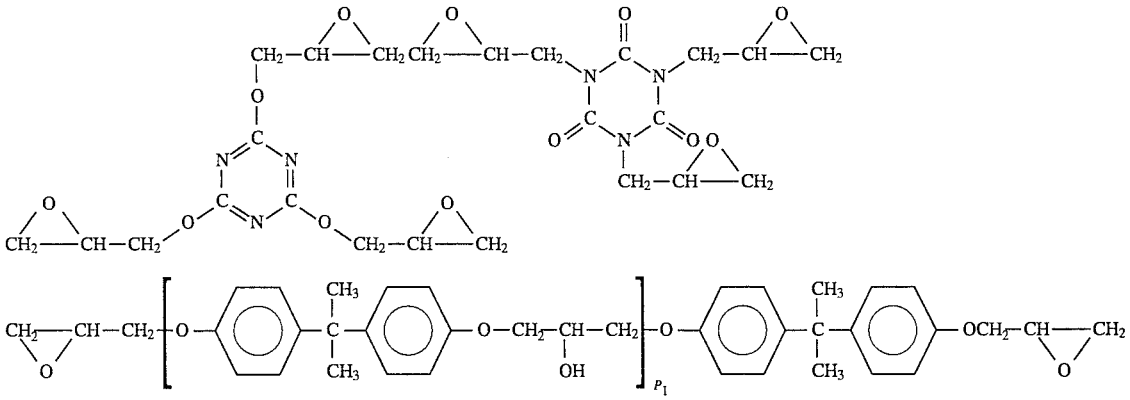
where $p_1$ represents an integer, and is preferably 0–10.
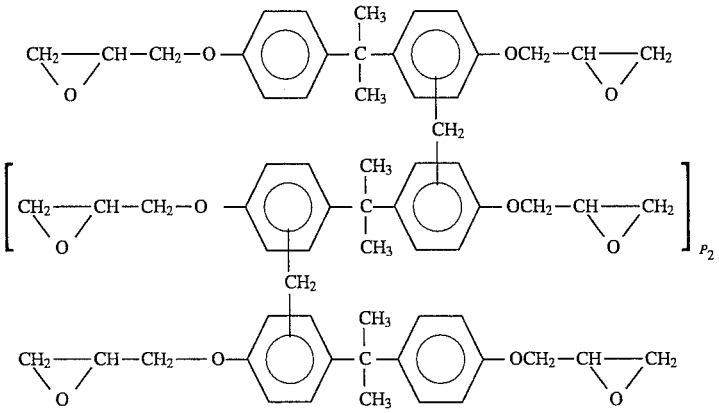
where $p_2$ represents an integer, preferably 0–10.
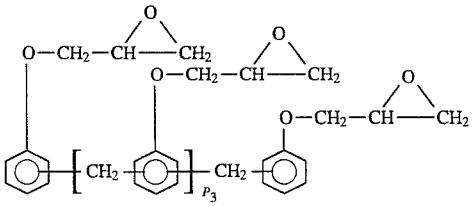
where $p_3$ represents an integer, preferably 0–10.
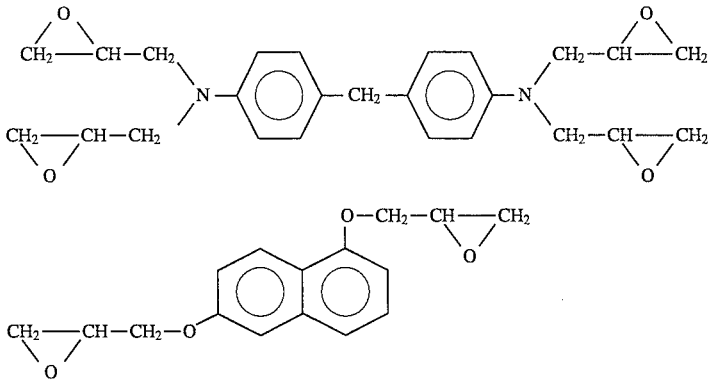

-continued
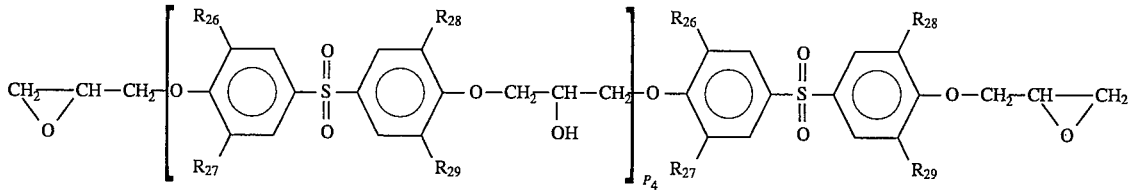
where $p_4$ represents an integer, preferably 0–10 and $R_{26}$–$R_{29}$ represent H— or $CH_3$—.
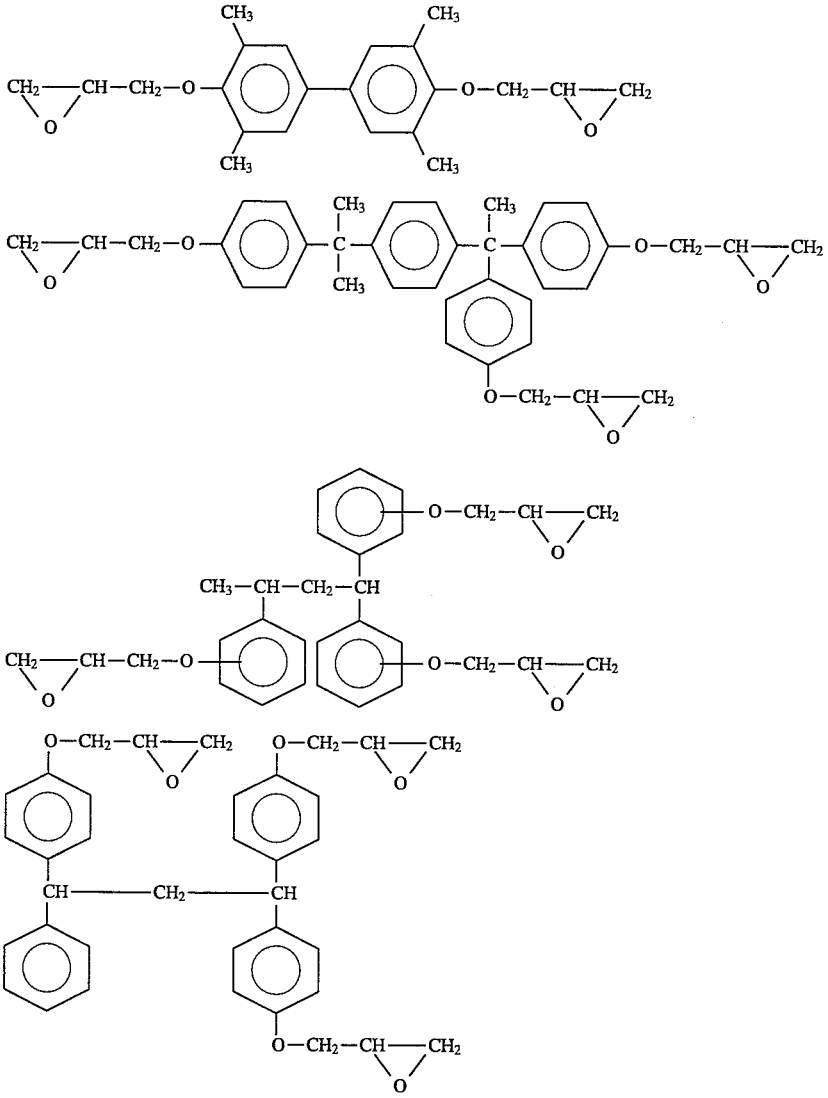

-continued
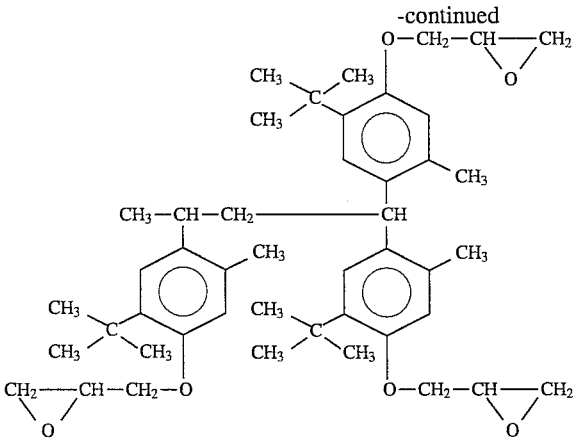
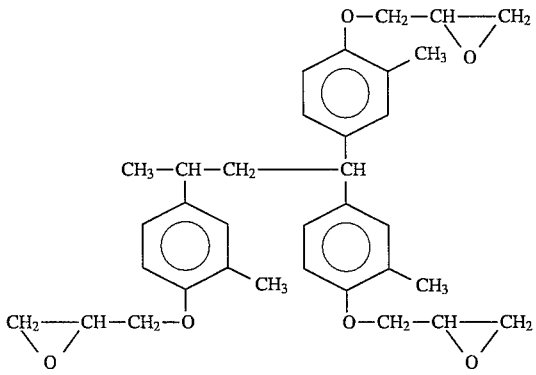
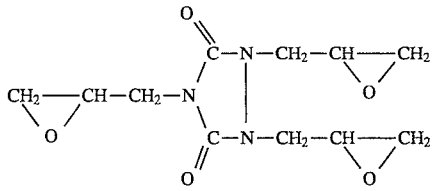
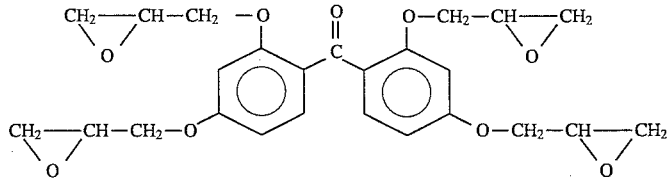
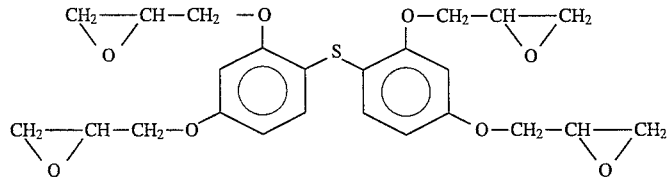
Preferred examples of the reactive (metha)acryl monomers or the reactive (metha)acryl oligomers are shown below.
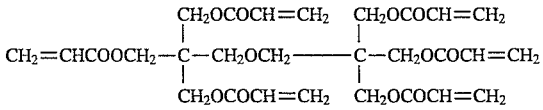

-continued

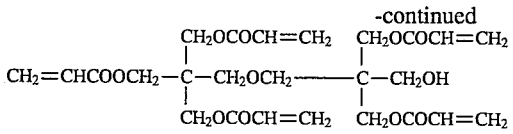

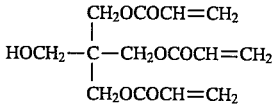

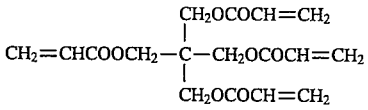

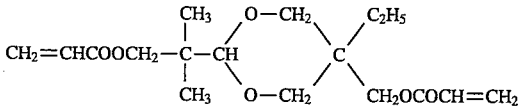

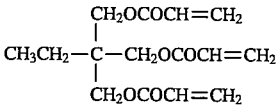

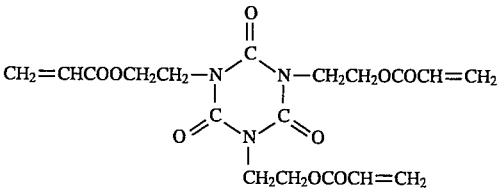

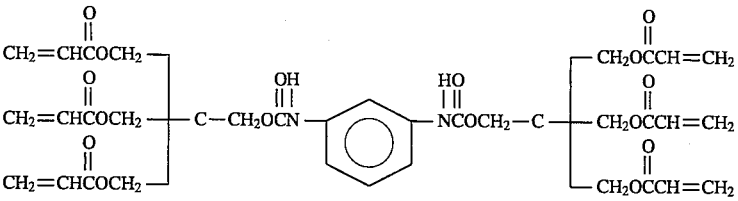

Polycarbonate resin (Q) also may be used alone as a binder resin or may be used by being mixed with some of these binder materials.

In the electrophotographic photosensitive member of the present invention, a protective layer containing polycarbonate resin (Q) may be formed on the photosensitive layer. The content of polycarbonate resin (Q) in the protective layer is, preferably, 10 to 100 wt %. The thickness of the protective layer is, preferably, 0.01 to 20 μm and, more preferably, 0.1 to 10 μm. The protective layer may contain a charge generating material, a charge transporting material, a metal, a metallic oxide, a metallic nitride, an metallic salt, an alloy, carbon and the like. The protective layer has a mechanical strength greater than that of the photosensitive layer and serves to increase the durability of the electrophotographic photosensitive member.

The supporting member is electrically conductive and may be formed of a metal, such as iron, copper, nickel, aluminum, titanium, tin, antimony, indium, lead, zinc, gold or silver; an alloy of such metals; an oxide of such metals, carbon; an electroconductive resin or the like. Preferably, the supporting member has a cylindrical, belt-like or sheet-like shape. The supporting member may be formed by molding a material selected from these electroconductive materials into a desired shape. Alternatively, it may be formed by applying the material to another supporting member in a coating manner or by vacuum-depositing the material on another supporting member.

An undercoating layer may be formed between the supporting member and the photosensitive layer. The undercoating layer, mainly formed of a binder resin, may contain the above-mentioned electroconductive material and an acceptor. Examples of the binder resin forming the undercoating layer are polyester, polyurethane, polyarylate, polyethylene, polystyrene, polybutadiene, polycarbonate, polyamide, polypropylene, polyimide, polyamide-imide, polysulfone, polyaryl either, polyacetal, nylon, phenolic resins, acrylic resins, silicone resins, epoxy resins, urea resins, aryl resins, alkyd resins, and butyral resins.

To apply the material of the photosensitive layer, a bar coater, a knife coater, a roll coater, an attritor, a spraying means, an immersion application means, an electrostatic application means, a powder coating means or the like is used.

The curing reaction of the polycarbonate having glycidyl end groups is caused by a thermal reaction method, a photo-reaction method or the like. If such a method is used, an initiator may suitably be used along with the end-reactive polycarbonate. In the case of thermal reaction curing, it is desirable that the curing temperature is not higher than 150° C. The following are examples of initiators available for photoreaction or thermal reaction:

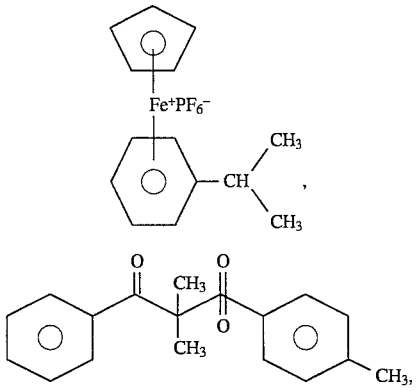

dimethyltriamine, triethylenetetramine, diethylaminopropylene, benzyldimethylamine, methaphenylenediamine, diaminodiphenylsulfone, phthalic anhydride, dodecylsuccinic anhydride, and dichlorosuccinic anhydride.

As a light source for photo-reaction, a high-voltage mercury lamp, a metal halide lamp, or an electrodeless microwave lamp, for example, can be used.

An electrophotographic apparatus and a facsimile machine using the electrophotographic photosensitive member of the present invention will be described below. FIG. 1 schematically shows the construction of an ordinary transfer type electrophotographic apparatus using a drum type photosensitive member 1 in accordance with the present invention. The drum type photosensitive member 1 is driven and rotated on a shaft 1*a* in the direction of the arrow at a predetermined peripheral speed. The photosensitive member 1 is uniformly charged at a predetermined positive or negative voltage at its circumferential surface by a charging means 2 during the rotation and then undergoes, at an exposure section 3, optical image exposure L (slit exposure, laser beam operation exposure or the like) effected by an unillustrated image exposure means. An electrostatic latent image corresponding to the exposure image is thereby formed gradually on a circumferential surface of the photosensitive member.

The electrostatic latent image is toner-developed by a development means 4 and the developed image is transferred successively to a surface of a transfer member P by a transfer means 5 while the transfer member P is being fed from an unillustrated sheet feed section to a position between the sensitive member 1 and the transfer means 5 in synchronization with the rotation of the photosensitive member 1. Having undergone the image transfer, the transfer sheet P is separated from the sensitive member surface and is lead to an image fixation means 8 to undergo image fixation. The transfer sheet P is then discharged as a printed copy out of the apparatus. From the surface of the photosensitive member 1 after the image transfer, residual toner is removed by a cleaning means 6, and the charge on the surface is then removed by the exposure means 7 to be repeatedly used for image formation. A corona charge device is ordinarily used as the means 2 for uniformly charging the photosensitive member 1. Also, a corona transfer means is ordinarily used as the transfer means 5.

In this electrophotographic apparatus, two or more of the above-described components including the photosensitive member, the development means and the cleaning means may be integrally combined to form a unit detachable from the apparatus body. For example, the photosensitive member 1 and the cleaning means 6 are combined into one unit which is detachably attached to the apparatus body with guide means such as rails on the apparatus body. In this case, the charging means and/or the development means may be constructed on the unit. If the electrophotographic apparatus is used as copying machine or a printer, optical image exposure L is effected in such a manner that the photosensitive member is irradiated with reflection light or transmission light from the original, or a signal is formed by reading the original with a sensor and scanning with a laser beam or driving an LED array or a liquid crystal shutter array is performed in accordance with this signal to irradiate the photosensitive member with light. If the electrophotographic apparatus is used as a facsimile printer, optical image exposure L is effected to print received data.

Figure 2:
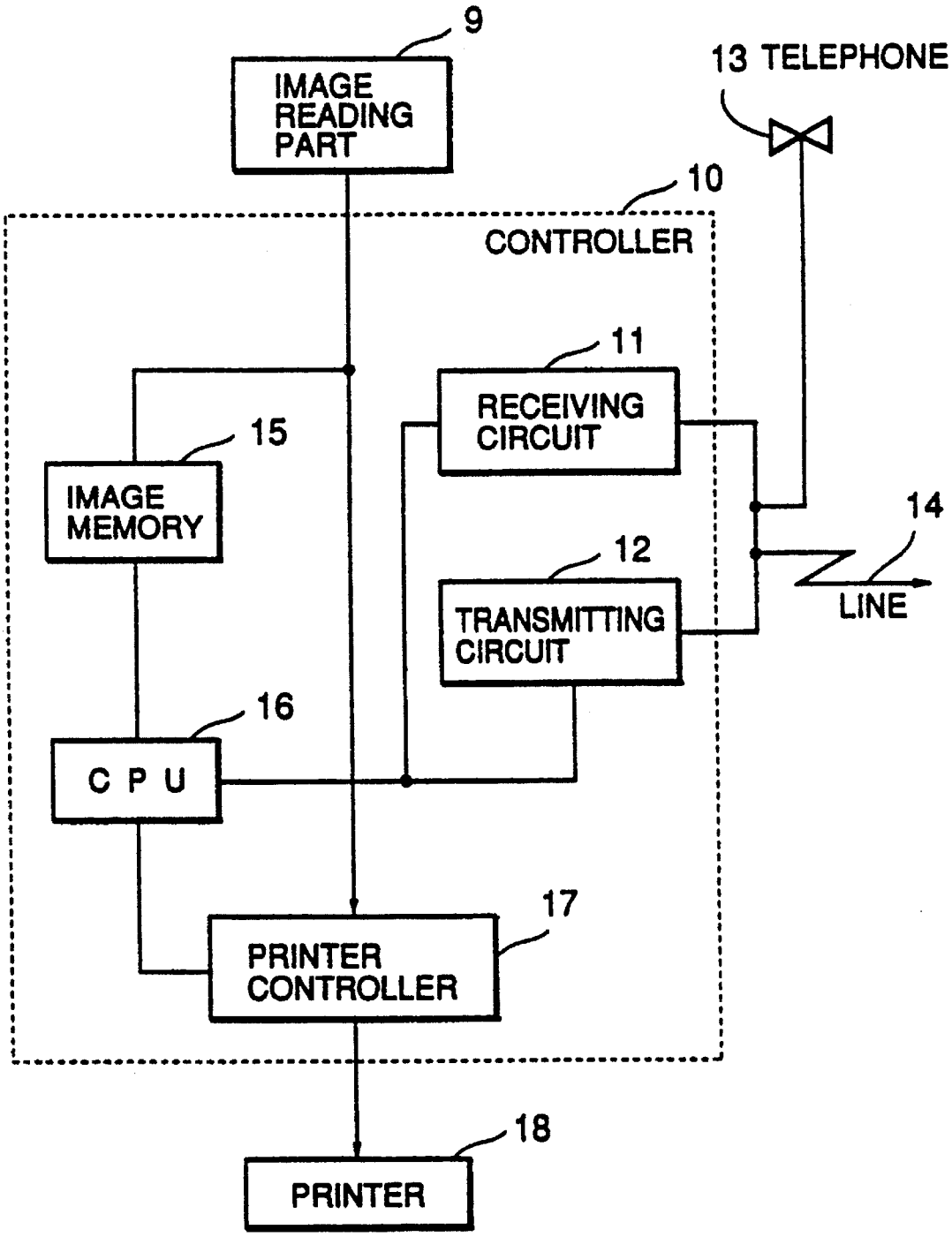
FIG. 2 is a block diagram of an example of a facsimile machine in which the electrophotographic apparatus of the present invention is used as a printer.

FIG. 2 is a block diagram of an example of a facsimile apparatus in which the electrophotographic apparatus is used as a printer. A controller 10 controls an image reading part 9 and a printer 18. The whole operation of the controller 10 is controlled by a CPU 16. Read data from the image reading part 9 is transmitted to terminal on the other end of the line through a transmitting circuit 12. Data received from the terminal on the other end of a line is sent to the printer 18 through a receiving circuit 11. Predetermined image data is stored in an image memory 15. A printer controller 17 controls the printer 18. A telephone 13 is connected to the facsimile machine.

An image signal received through a circuit 14 (image information from a remote terminal connected through the circuit) is demodulated by the receiving circuit 11. Image information thereby obtained is processed by the CPU 16 and is successively stored in the image memory 15. When image information corresponding to at least one page is stored in the memory 15, the corresponding image is recorded. The CPU 16 reads out image information corresponding to one page from the memory 15, forms a signal representing this information and sends the same to the printer controller 17. The printer controller 17 controls the printer 18 to record the image in accordance with the one-page image information received from the CPU 16. The CPU 16 receives information on the next page during the recording effected by the printer 18. Image receiving/recording is performed in the above-described manner. The following Examples illustrate certain preferred embodiments of the invention and are not limitative of scope.

EXAMPLE 1

10 parts (parts by weight, also shortened in the following) of methoxymethylated nylon and 150 parts of isopropanol were mixed and dissolved, and a 1 um undercoating layer was formed on an aluminum cylinder having an outside diameter of 80 mm and length of 360 mm by applying the mixture liquid to the cylinder in an immersion application manner.

Next, 10 parts of a trisazo pigment:

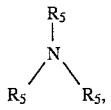

-continued

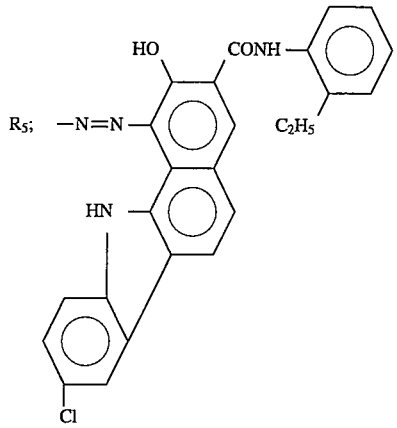

5 parts of polycarbonate (bisphenol A type, having a molecular weight of 30,000), and 700 parts of cyclohexane were dispersed by a sand mill, and a 0.05 μm charge generation layer was formed on the undercoating layer by applying the dispersion to the cylinder in an immersion application manner.

Next, 10 parts of triphenylamine:

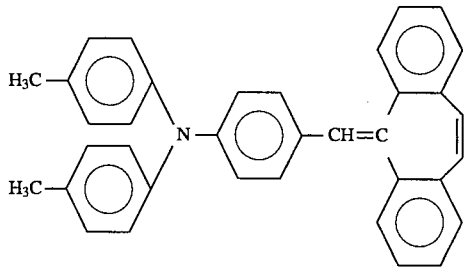

7 parts of end-reactive polycarbonate (bisphenol Z type, having a molecular weight of 20,000):

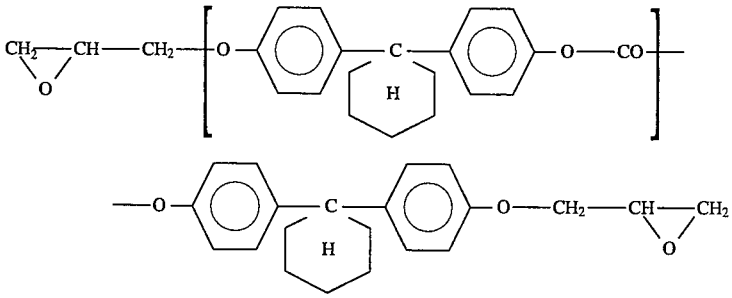

3 parts of non-end-reactive polycarbonate (bisphenol type, having a molecular weight of 25,000):

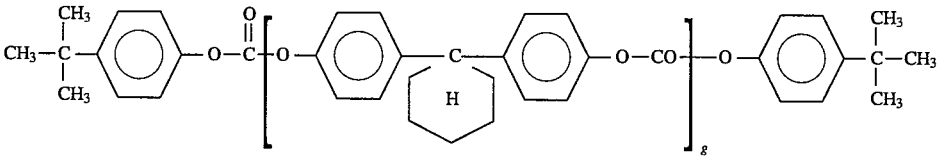

0.2 part of a polymerization initiator:

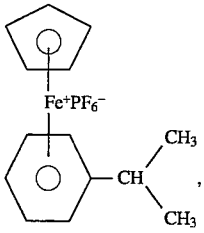

150 parts of chlorobenzene, 100 parts of dichloromethane were mixed and dissolved, and this liquid mixture was applied to the charge generation layer by immersion application. After the application, the cylinder was hot-air dried and the coating film was photo-set with an electrodeless microwave lamp (wavelength: 365 nm), thereby forming a charge transport layer having a thickness of 20 um. An electrophotographic photosensitive member in accordance with the present invention was made in this manner. Such a type of cylindrical photosensitive member will be hereinafter referred to as a type 1 electrophotographic photosensitive member.

Another electrophotographic photosensitive member in accordance with the present invention was made in the same manner as the above-described type 1 electrophotographic photosensitive member except that an aluminum sheet having a thickness of 50 mm was used. Such a type of sheet-like photosensitive member will be hereinafter referred to as a type 2 electrophotographic photosensitive member.

Comparative Example

Type 1 and type 2 electrophotographic photosensitive members were made in the same manner as Example 1 except that 7 parts of the end-reactive polycarbonate used in Example 1 was replaced with 7 parts of the non-end-reactive polycarbonate used in Example 1.

The electrophotographic photosensitive members in accordance with Example 1 and the comparative example were examined by an abrasion resistance test, a scratch test and an endurance test described below.

Abrasion Resistance Test

The type 2 electrophotographic photosensitive member in accordance with Example 1 and the type 2 electrophotographic photosensitive member in accordance with the comparative example were examined by a 1 kg load 5,000 cycle abrasion test (using a Taber Type Abrasion Tester, a product from Yasuda Seiki Seisakusho). The reduction in the weight of the Example 1 photosensitive member caused by abrasion was smaller than that in the comparative example photosensitive member by about 20%. Thus, an effect of using the formula (1) polycarbonate was recognized.

Scratch Test

The type 2 electrophotographic photosensitive member in accordance with Example 1 and the type 2 electrophotographic photosensitive member in accordance with the comparative example were examined by a scratch test (using a Heidon 14 type surface profile measuring apparatus, a product from Nitto Kagaku).

In the scratch test, the photosensitive member surface was scratched by a diamond needle having an end diameter of 0.05 mm and the depth of the scratch was measured. The diamond needle was weighted at 50 g. As result, the depth of the scratch in the Example 1 photosensitive member was smaller than that in the comparative example photosensitive member by about 15%. Thus, an effect of using the formula (1) polycarbonate was recognized also with respect to the surface hardness.

Endurance Test

The type 1 electrophotographic photosensitive member in accordance with Example 1 and the type 1 electrophotographic photosensitive member in accordance with the comparative example were examined by a duration test using a copying machine (CLC 500, a product from Canon Inc.). In this test, the photosensitive member was used for copying on 20,000 sheets of recording sheets. A good image was obtained during 20,000 sheet copying in the case of using the Example 1 photosensitive member. On the other hand, in the case of the comparative example photosensitive member, the white image background was considerably fogged after 13,000 copies and the photosensitive member became unusable. After the endurance test, the extent of abrasion in the surface of each photosensitive member was measured. The reduction in the thickness of the Example 1 photosensitive member caused by abrasion was smaller than that of the comparative example photosensitive member by 25%.

EXAMPLE 2

30 parts of the triphenylamine compound used in Example 1, 50 parts of the end-reactive polycarbonate used in Example 1, 20 parts of a non-end-reactive polycarbonate having the same structure as the non-endreactive polycarbonate used in Example 1 and having a molecular weight of 70,000, 0.25 part of the polymerization initiator used in Example 1, 1,000 parts of chlorobenzene and 500 parts of dichloromethane were dissolved and mixed, and the mixed liquid was applied, by spraying, to the surface of each of the above-described type 1 and type 2 photosensitive members in accordance with the comparative example. The coating film thereby formed was hot-air dried and irradiated with light to form a protective layer, thereby obtaining type 1 and type 2 electrophotographic photosensitive members in accordance with the present invention. These electrophotographic photosensitive members were also examined in the same manner as Example 1 by the abrasion resistance test, the scratch test and the endurance test. Table 1 shows the results of these tests.

EXAMPLE 3

30 parts of the triphenylamine compound used in Example 1, 30 parts of the end-reactive polycarbonate used in Example 1, 20 parts of an epoxy monomer expressed by the following structural formula:

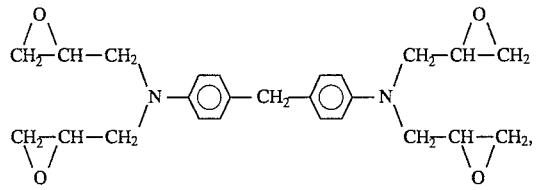

20 parts of the non-end-reactive polycarbonate used in Example 2, 0.25 part of the polymerization initiator used in Example 1, 1,000 parts of chlorobenzene and 500 parts of dichloromethane were dissolved and mixed, and the liquid mixture was applied to the surface of each of the type 1 and type 2 photosensitive members in accordance with the comparative example and were formed as a protective layer in the same manner as Example 2, thereby obtaining type 1 and type 2 electrophotographic photosensitive members in accordance with the present invention. These electrophotographic photosensitive members were also examined in the same manner as Example 1 by the abrasion resistance test, the scratch test and the endurance test. Table 1 shows the results of the tests.

EXAMPLE 4

30 parts of the triphenylamine compound used in Example 1, 30 parts of the end-reactive polycarbonate used in Example 1, 20 parts of an epoxy monomer expressed by the following structural formula:

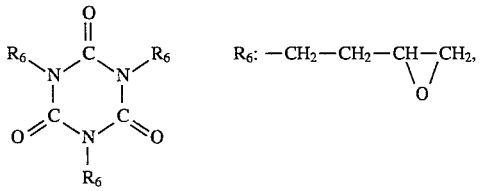

20 parts of the non-end-reactive polycarbonate used in Example 2, 0.25 part of the polymerization initiator used in Example 1, 1,000 parts of chlorobenzene and 500 parts of dichloromethane were dissolved and mixed, and the liquid mixture was applied to the surface of each of the type 1 and type 2 photosensitive members in accordance with the comparative example and were formed as a protective layer in the same manner as Example 2, thereby obtaining type 1 and type 2 electrophotographic photosensitive members in accordance with the present invention. These electrophotographic photosensitive members were also examined in the same manner as Example 1 by the abrasion resistance test, the scratch test and the endurance test. Table 1 shows the results of these tests.

EXAMPLE 5

30 parts of the triphenylamine compound used in Example 1, 30 parts of the end-reactive polycarbonate used in Example 1, 10 parts of an epoxy monomer A expressed by the following structural formula:

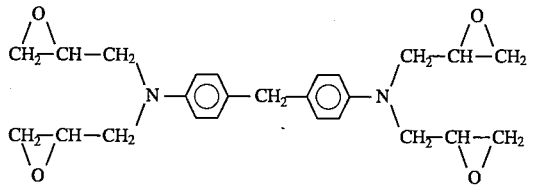

10 parts of an epoxy monomer AA expressed by the following structural formula:

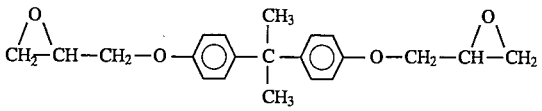

20 parts of the non-end-reactive polycarbonate used in Example 2, 0.25 part of the polymerization initiator used in Example 1, 1,000 parts of chlorobenzene and 500 parts of dichloromethane were dissolved and mixed, and the liquid mixture was applied to the surface of each of the type 1 and type 2 photosensitive members in accordance with the comparative example and were formed as a protective layer in the same manner as Example 2, thereby obtaining type 1 and type 2 electrophotographic photosensitive members in accordance with the present invention. These electrophotographic photosensitive members were also examined in the same manner as Example 1 by the abrasion resistance test, the scratch test and the endurance test. Table 1 shows the results of these tests.

EXAMPLE 6

30 parts of the triphenylamine used in Example 1, 30 parts of an end-reactive polycarbonate having the following structure (molecular weight: 20,000):

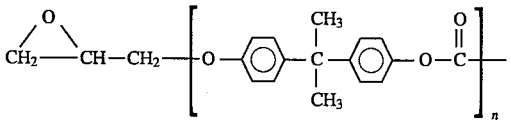

-continued

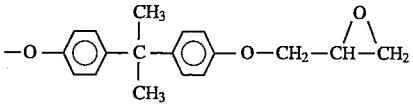

20 parts of an epoxy resin having the following structure:

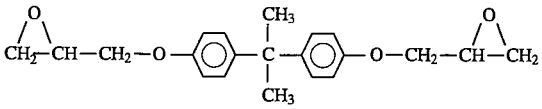

20 parts of the non-end-reactive polycarbonate used in Example 2, 0.25 part of the polymerization initiator used in Example 1, 1,000 parts of chlorobenzene and 500 parts of dichloromethane were dissolved and mixed, and the liquid mixture was applied to the surface of each of the type 1 and type 2 photosensitive members in accordance with the comparative example and were formed as a protective layer in the same manner as Example 2, thereby obtaining type 1 and type 2 electrophotographic photosensitive members in accordance with the present invention. These electrophotographic photosensitive members were also examined in the same manner as Example 1 by the abrasion resistance test, the scratch test and the endurance test. Table 1 shows the results of these tests.

EXAMPLE 7

30 parts of the triphenylamine used in Example 1, 30 parts of an end-reactive polycarbonate having the following structure (molecular weight: 20,000):

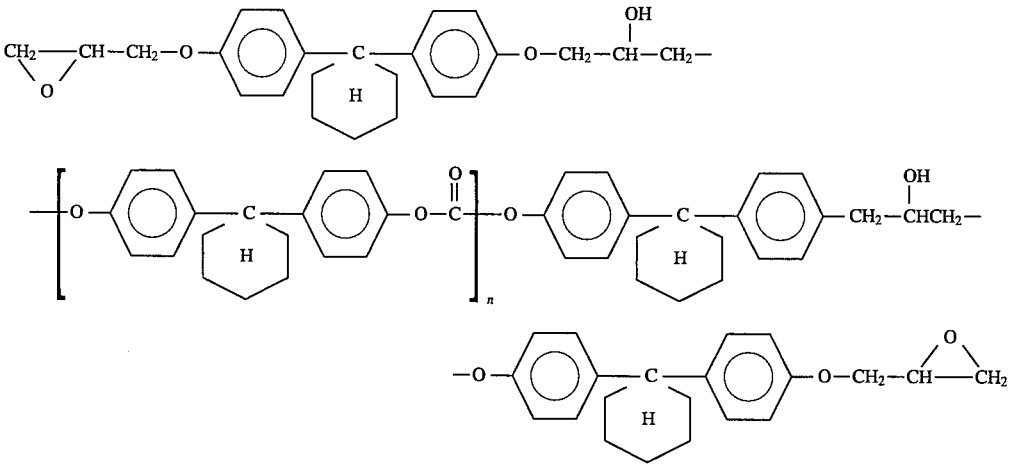

20 parts of an epoxy resin having the following structure:

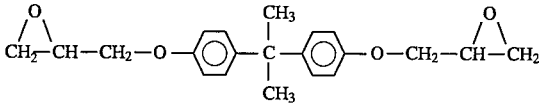

20 parts of the non-end-reactive polycarbonate used in Example 2, 0.25 part of the polymerization initiator used in Example 1, 1,000 parts of chlorobenzene and 500 parts of dichloromethane were dissolved and mixed, and the liquid mixture was applied to the surface of each of the type 1 and type 2 photosensitive members in accordance with the comparative example and were formed as protective layer in the same manner as Example 2, thereby obtaining type 1 and type 2 electrophotographic photosensitive members in accordance with the present invention. These electrophotographic photosensitive members were also examined in the same manner as Example 1 by the abrasion resistance test, the scratch test and the endurance test. Table 1 shows the results of these tests.

EXAMPLE 8

The same protective layer as that in Example 3 was formed, in the same manner as Example 3, on each of type 1 and type 2 electrophotographic photosensitive member formed in accordance with Example 1 . Type 1 and type 2 electrophotographic photosensitive members were thereby obtained.

The electrophotographic photosensitive members were also examined in the same manner as Example 1 by the abrasion resistance test, the scratch test and the endurance test. Table 1 shows the results of these tests.

EXAMPLE 9

Type 1 and type 2 electrophotographic photosensitive members were made in the same manner as Example 1 except that the end-reactive polycarbonate used in Example 1 was replaced with the following end-reactive polycarbonate having molecular weight of 25,000.

The electrophotographic photosensitive members were examined by an abrasion resistance test, a scratch test and an endurance test, in the same manner as in Example 1. The results are shown in Table 1.

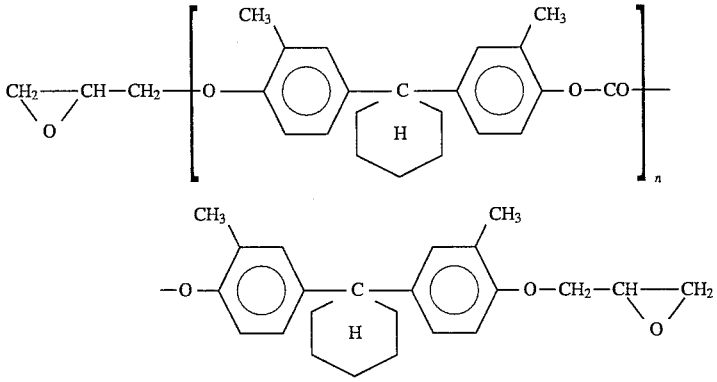

EXAMPLE 10

Type 1 and type 2 electrophotographic photosensitive members were made in the same manner as Example 2 except that the end-reactive polycarbonate used in Example 2 was replaced with the end-reactive polycarbonate used in Example 9.

The electrophotographic photosensitive members were examined by an abrasion resistance test, a scratch test and an endurance test, in the same manner as in Example 1. The results are shown in Table 1.

EXAMPLE 11

Type 1 and type 2 electrophotographic photosensitive members were made in the same manner as Example 3 except that the end-reactive polycarbonate used in Example 3 was replaced with the end-reactive polycarbonate used in Example 9.

The electrophotographic photosensitive members were examined by an abrasion resistance test, a scratch test and an endurance test, in the same manner as in Example 1. The results are shown in Table 1.

EXAMPLE 12

Type 1 and type 2 electrophotographic photosensitive members were made in the same manner as Example 3 except that the reactive epoxy monomer used in Example 3 was replaced with the reactive acryl monomer represented by the following structural formula (i), and further 0.2 part of the polymerization initiator represented by the following formula (ii) was added.

The electrophotographic photosensitive members were examined by an abrasion resistance test, a scratch test and an endurance test, in the same manner as in Example 1. The results are shown in Table 1.

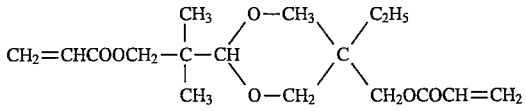

(i)

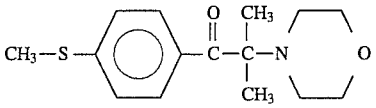

(ii)

TABLE 1

| | Abrasion | | Duration test | |
|---|---|---|---|---|
| Samples | loss measured in abrasion resistane test (mg) | Depth of scratch measured in scratch test (μm) | Reduction in thickness (μm/10,000 sheets | white image background fog |
| Example 1 | 6.6 | 4.7 | 6.3 | No fog |
| Example 2 | 6.7 | 4.9 | 6.1 | No fog |
| Example 3 | 4.2 | 3.5 | 5.8 | No fog |
| Example 4 | 3.3 | 3.3 | 4.5 | No fog |
| Example 5 | 2.4 | 3.2 | 3.2 | No fog |
| Example 6 | 2.9 | 3.3 | 3.5 | No fog |

TABLE 1-continued

| Samples | Abrasion loss measured in abrasion resistane test (mg) | Depth of scratch measured in scratch test (μm) | Duration test: Reduction in thickness (μm/10,000 sheets | Duration test: white image background fog |
|---|---|---|---|---|
| Example 7 | 2.8 | 3.4 | 3.6 | No fog |
| Example 8 | 4.1 | 3.2 | 5.4 | No fog |
| Example 9 | 6.3 | 4.9 | 5.9 | No fog |
| Example 10 | 6.1 | 4.8 | 6.0 | No fog |
| Example 11 | 4.1 | 3.8 | 5.2 | No fog |
| Example 12 | 4.3 | 3.7 | 5.5 | No fog |
| Comparative Example 1 | 8.3 | 5.5 | 8.2 | Fog occurred |

Other variations and embodiments will be apparent to those of ordinary skill in the art. The present invention is not to be limited except as set forth in the following claims.

What is claimed is:

1. An electrophotographic photosensitive member comprising: (a) a photosensitive layer on a supporting member, and (b), optionally, a protective layer on said photosensitive layer, wherein at least one of said (a) and (b) is formed of a material containing a cured resin obtained by end-reactive curing of a polycarbonate having glycidyl end groups.

2. An electrophotographic photosensitive member according to claim 1, wherein said polycarbonate is represented by the following general formula (1):

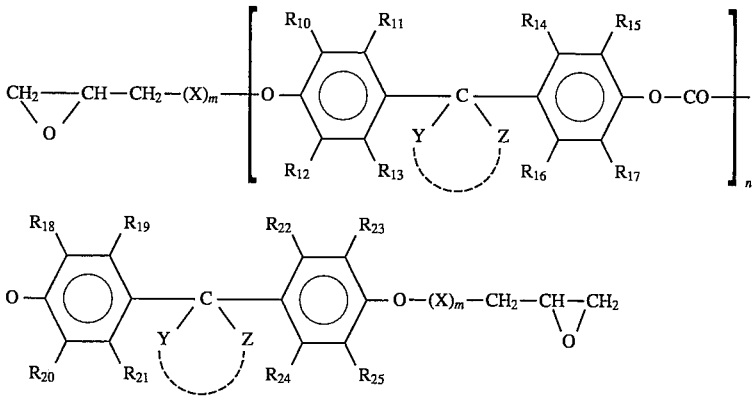

wherein $R_{10}$–$R_{25}$ are each a hydrogen atom, an alkyl group, an aryl group, a halogen atom or a halogenated alkyl group;

X is an aryl group, an alkyl group, an aralkyl group or a group selected from the following formulae:

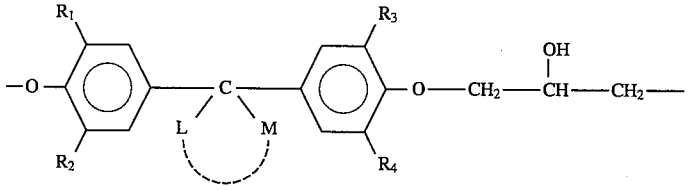

-continued

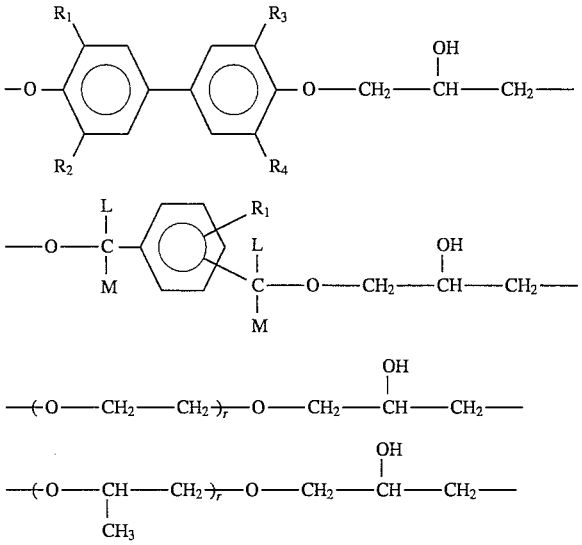

wherein $R_1$, $R_2$, $R_3$ and $R_4$ are each a hydrogen atom, an alkyl group, a halogenated alkyl group, an aryl group, or a halogen atom; r is an integer; L and M are each a hydrogen atom, an alkyl group, a halogenated alkyl group, an aryl group, or an aralkyl group, or together constitute a cyclic alkyl group; m is 0 or 1; Y and Z are each hydrogen atom, an alkyl group, an aryl group, an aralkyl group, a halogen atom or a halogenated alkyl group, or together constitute a cyclic alkyl group; n is an integer from 3 to 340; and each of $R_1$, $R_2$, $R_3$, $R_4$, L, M, X, Y and Z is unsubstituted or substituted with a moiety selected from the group consisting of $C_1$–$C_6$ alkyl, aralkyl, aromatic cyclic, heterocyclic, alkoxy, halogen, nitro, cyano, amino and haloalkyl.

3. An electrophotographic photosensitive member according to claim 1, comprising said photosensitive layer and said protective layer and wherein said photosensitive layer is formed of said material containing said resin.

4. An electrophotographic photosensitive member comprising: a photosensitive layer on a supporting member, said photosensitive layer being formed of a material containing a cured resin obtained by end-reactive curing of a polycarbonate having glycidyl end groups.

5. An electrophotographic photosensitive member according to claim 4, wherein said polycarbonate is represented by the following general formula (1):

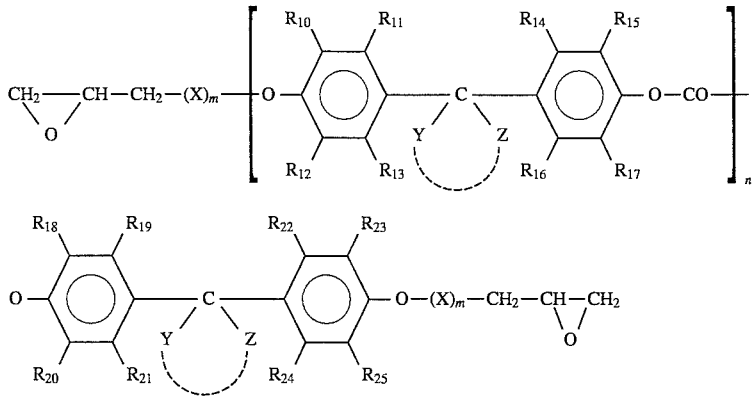

wherein $R_{10}$–$R_{25}$ are each a hydrogen atom, an alkyl group, an aryl group, a halogen atom or a halogenated alkyl group; X is an aryl group, an alkyl group, an aralkyl group or a group selected from the following formulae:

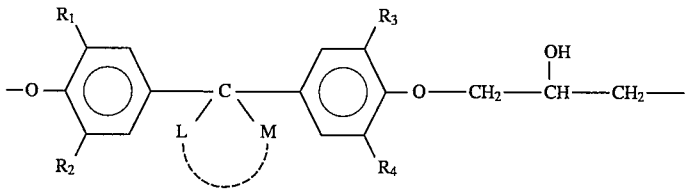

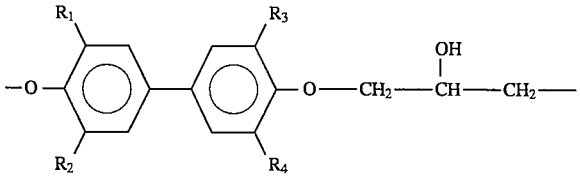

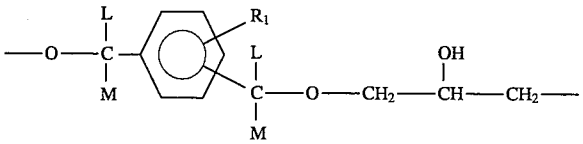

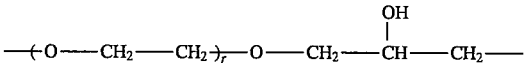

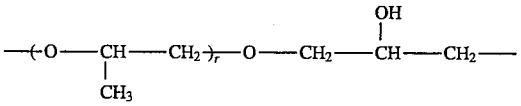

wherein $R_1$, $R_2$, $R_3$ and $R_4$ are each a hydrogen atom, an alkyl group, a halogenated alkyl group, an aryl group, or a halogen atom; r is an integer; L and M are each a hydrogen atom, an alkyl group, a halogenated alkyl group, an aryl group, or an aralkyl group, or together constitute a cyclic alkyl group; m is 0 or 1; Y and Z are each hydrogen atom, an alkyl group, an aryl group, an aralkyl group, a halogen atom or a halogenated alkyl group, or together constitute a cyclic alkyl group; n is an integer from 3 to 340; and each of $R_1$, $R_2$, $R_3$, $R_4$, L, M, X, Y and Z is unsubstituted or substituted with a moiety selected from the group consisting of $C_1$–$C_6$ alkyl, aralkyl, aromatic cyclic, heterocyclic, alkoxy, halogen, nitro, cyano, amino and haloalkyl.

6. An electrophotographic photosensitive member according to claims 1 or 4, wherein said photosensitive layer is a single layer.

7. An electrophotographic photosensitive member according to claims 1 or 4, wherein said photosensitive layer has a laminated structure formed of a charge generation layer and a charge transport layer.

8. An electrophotographic photosensitive member according to any one of claims 2 or 5, wherein X in the general formula (1) is selected from the groups consisting of the following formulae:

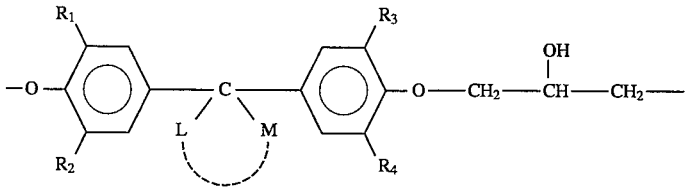

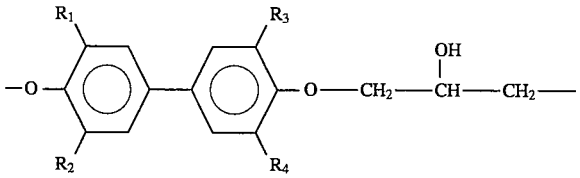

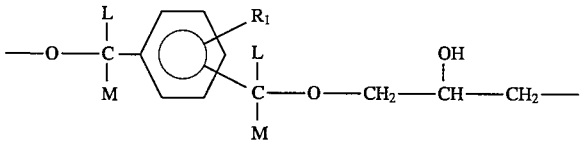

-continued

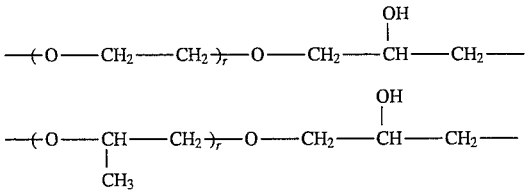

wherein $R_1$, $R_2$, $R_3$ and $R_4$ are each a hydrogen atom, an alkyl group, a halogenated alkyl group, an aryl group, or a halogen atom; r is an integer; L and M are each a hydrogen atom, an alkyl group, a halogenated alkyl group, an aryl group, or an aralkyl group, or together constitute a cyclic alkyl group; and $R_1$, $R_2$, $R_3$, $R_4$, L and M are unsubstituted or substituted with a moiety selected from the group consisting of $C_1$–$C_6$ alkyl, aralkyl, aromatic cyclic, heterocyclic, alkoxy, halogen, nitro, cyano, amino and haloalkyl.

9. An electrophotographic photosensitive member comprising, in sequence: a supporting member; a photosensitive layer on said supporting member and a protective layer on said photosensitive layer, wherein at least said protective layer is formed of a material containing a cured resin obtained by end-reactive curing of a polycarbonate having glycidyl end groups.

10. An electrophotographic photosensitive member according to claim 9, wherein said polycarbonate is

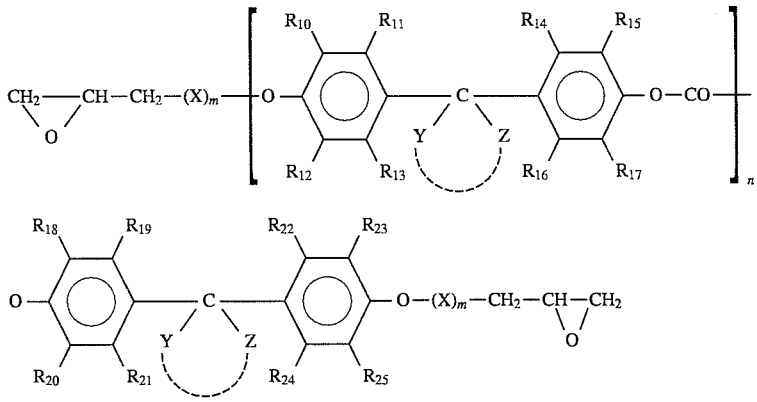

wherein $R_{10}$–$R_{25}$ are each a hydrogen atom, an alkyl group, an aryl group, a halogen atom or a halogenated alkyl group; X is an aryl group, an alkyl group, an aralkyl group or a group selected from the following formulae:

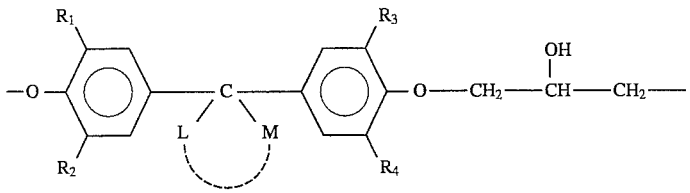

-continued

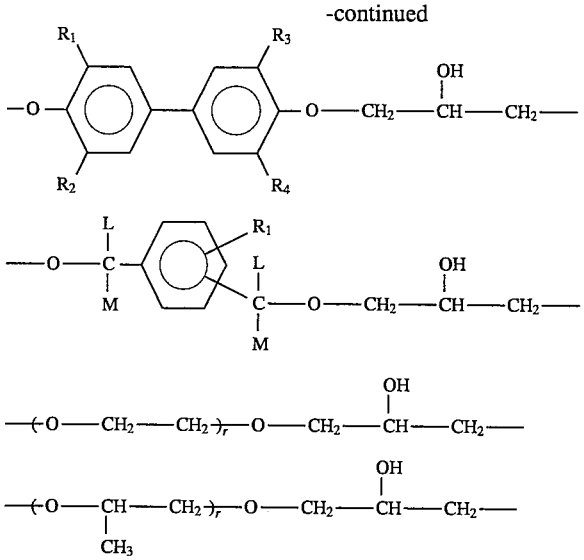

wherein $R_1$, $R_2$, $R_3$ and $R_4$ are each a hydrogen atom, an alkyl group, a halogenated alkyl group, an aryl group, or a halogen atom; r is an integer; L and M are each a hydrogen atom, an alkyl group, a halogenated alkyl group, an aryl group, or an aralkyl group, or together constitute a cyclic alkyl group; m is 0 or 1; Y and Z are each a hydrogen atom, an alkyl group, an aryl group, an aralkyl group, a halogen atom or a halogenated alkyl group, or together constitute a cyclic alkyl group; n is an integer from 3 to 340; and each of $R_1$, $R_2$, $R_3$, $R_4$, L, M, X, Y and Z is unsubstituted or substituted with a moiety selected from the group consisting of $C_1$–$C_6$ alkyl, aralkyl, aromatic cyclic, heterocyclic, alkoxy, halogen, nitro, cyano, amino and haloalkyl.

11. An electrophotographic photosensitive member according to claim 10, wherein X in the general formula (1) is selected from the group consisting of the following formulae:

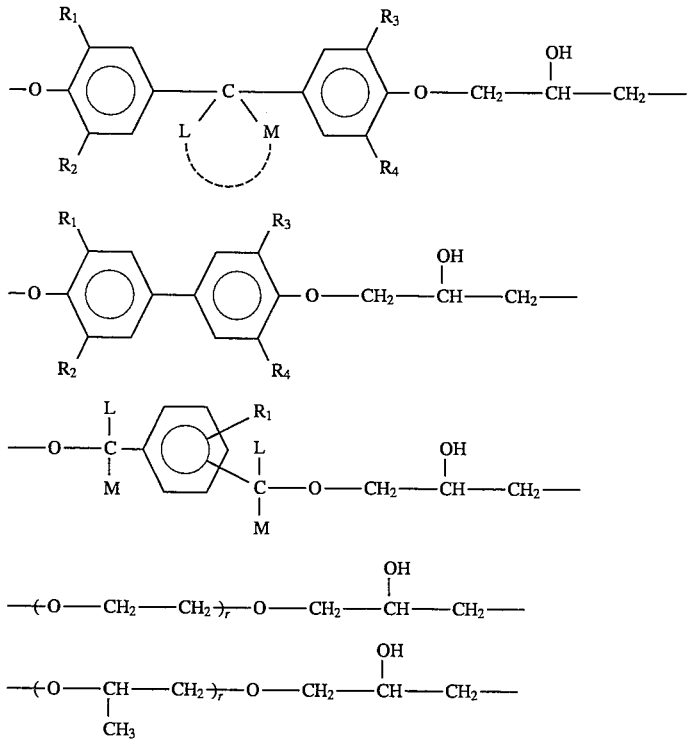

wherein $R_1$, $R_2$, $R_3$ and $R_4$ are each a hydrogen atom, an alkyl group, a halogenated alkyl group, an aryl group, or a halogen atom; r is an integer; L and M are each a hydrogen atom, an alkyl group, a halogenated alkyl group, an aryl group, or an aralkyl group, or together constitute a cyclic alkyl group; and $R_1$, $R_2$, $R_3$, $R_4$, L and M are unsubstituted or substituted with a moiety selected from the group consisting of $C_1$–$C_6$ alkyl, aralkyl, aromatic cyclic, heterocyclic, alkoxy, halogen, nitro, cyano, amino and haloalkyl.

12. An electrophotographic photosensitive member according to claim 9, wherein said photosensitive layer is a single layer.

13. An electrophotographic photosensitive member according to claim 9, wherein said photosensitive layer has a laminated structure formed of a charge generation layer and a charge transport layer.

14. An electrophotographic photosensitive member according to claim 9, wherein both said photosensitive layer and said protective layer are formed of said material containing said resin.

15. An electrophotographic photosensitive member comprising: (a) a photosensitive layer on a supporting member, and (b), optionally, a protective layer on said photosensitive layer, wherein at least one of said (a) and (b) is formed of a material containing a cured resin obtained by end-reactive curing of a polycarbonate having glycidyl end groups and a reactive epoxy monomer binder.

16. An electrophotographic photosensitive member according to claim 15, wherein said polycarbonate is represented by the following general formula (1) and said reactive epoxy monomer binder:

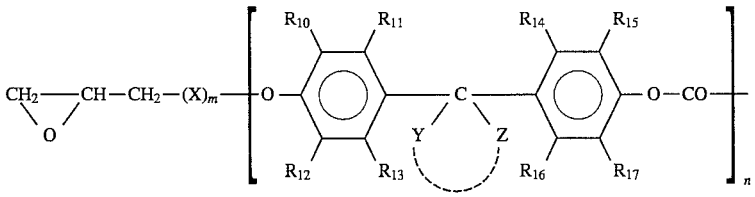

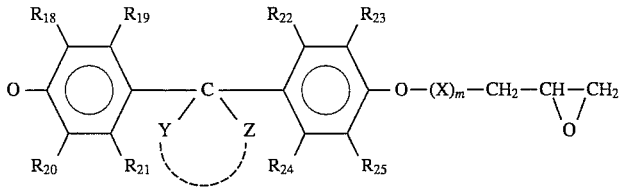

wherein $R_{10}$–$R_{25}$ are each a hydrogen atom, an alkyl group, an aryl group, a halogen atom or a halogenated alkyl group;

X is an aryl group, an alkyl group, an aralkyl group or a group selected from the following formulae:

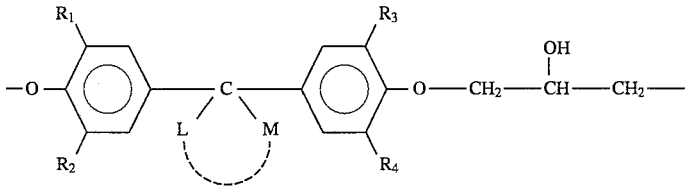

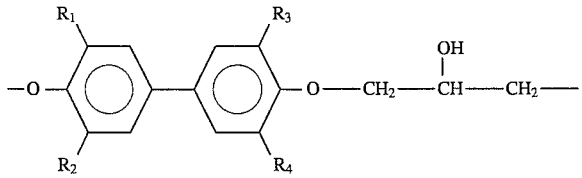

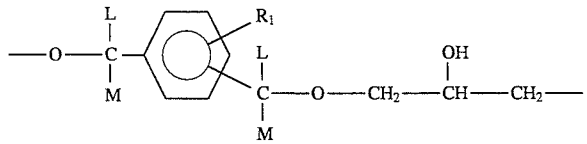

-continued

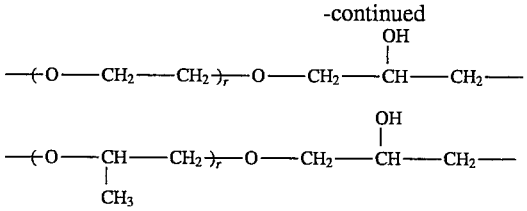

wherein $R_1$, $R_2$, $R_3$ and $R_4$ are each a hydrogen atom, an alkyl group, a halogenated alkyl group, an aryl group, or a halogen atom; r is an integer; L and M are each a hydrogen atom, an alkyl group, a halogenated alkyl group, an aryl group, or an aralkyl group, or together constitute a cyclicalkyl group; m is 0 or 1; Y and Z are each hydrogen atom, an alkyl group, an aryl group, an aralkyl group, a halogen atom or a halogenated alkyl group, or together constitute a cyclic alkyl group; n is an integer from 3 to 340; and each of $R_1$, $R_2$, $R_3$, $R_4$, L, M, X, Y and Z is unsubstituted or substituted with a moiety selected from the group consisting of $C_1$–$C_6$ alkyl, aralkyl, aromatic cyclic, heterocyclic, alkoxy, halogen, nitro, cyano, amino and haloalkyl.

* * * * *

UNITED STATES PATENT AND TRADEMARK OFFICE

CERTIFICATE OF CORRECTION

PATENT NO. : 5,585,214

DATED : December 17, 1996

INVENTORS : NOBORU KASHIMURA ET AL.

It is certified that error appears in the above-identified patent and that said Letters Patent is hereby corrected as shown below:

COLUMN 1

Line 33, "than" should read --to--;
Line 61, "space saving" should read --space-saving--.

COLUMN 15

Line 51, "an" (first occurrence) should read --a--.

COLUMN 18

Line 21, "terminal" should read --a terminal--.

COLUMN 19

Line 54, "(bisphenol type," should read --(bisphenol Z type,--;
Line 65, insert: --(g:integer)--.

COLUMN 21

Line 56, "non-endreactive" should read --non-end-reactive--.

UNITED STATES PATENT AND TRADEMARK OFFICE

CERTIFICATE OF CORRECTION

PATENT NO. : 5,585,214

DATED : December 17, 1996

INVENTORS : NOBORU KASHIMURA ET AL.

It is certified that error appears in the above-identified patent and that said Letters Patent is hereby corrected as shown below:

COLUMN 22

Line 43, "$R_6$: $-CH_2-CH_2-\underset{\underset{O}{\backslash\ /}}{CH}-CH_2$," should read --$R_6$: $-CH_2-\underset{\underset{O}{\backslash\ /}}{CH}-CH_2$,--

COLUMN 25

Line 14, "member" should read --members--.

COLUMN 26

Line 60, "sheets" should read --sheets)--.

UNITED STATES PATENT AND TRADEMARK OFFICE

CERTIFICATE OF CORRECTION

PATENT NO. : 5,585,214

DATED : December 17, 1996

INVENTORS : NOBORU KASHIMURA ET AL.

It is certified that error appears in the above-identified patent and that said Letters Patent is hereby corrected as shown below:

COLUMN 27

Line 9, "sheets" should read --sheets)--.

Signed and Sealed this

Twenty-ninth Day of July, 1997

Bruce Lehman

*Attest:*

BRUCE LEHMAN

*Attesting Officer*

*Commissioner of Patents and Trademarks*